US005783788A

United States Patent [19]

Jones et al.

[11] Patent Number: 5,783,788

[45] Date of Patent: Jul. 21, 1998

[54] BI-DIRECTIONAL MULTI-POSITION POSITIONING DEVICE

[75] Inventors: Gary Arthur Jones, Pleasant Grove, Utah; James Torrie Wellington, Westlake Village, Calif.

[73] Assignee: Digital Technologies, Inc., Pleasant Grove, Utah

[21] Appl. No.: 551,826

[22] Filed: Nov. 7, 1995

[51] Int. Cl.[6] ..... H01H 19/14

[52] U.S. Cl. ..... 200/51.17; 200/570

[58] Field of Search ..... 200/565, 570, 200/51.17

[56] References Cited

U.S. PATENT DOCUMENTS

| | | | |
|---|---|---|---|
| 360,244 | 3/1887 | Perkins . | |
| 476,183 | 5/1892 | Ball . | |
| 676,074 | 6/1901 | McCullough . | |
| 704,851 | 7/1902 | Beecher, Jr. . | |
| 771,988 | 10/1904 | Lovejoy . | |
| 780,678 | 1/1905 | Meyers . | |
| 1,415,120 | 5/1922 | Rooney . | |
| 1,449,627 | 3/1923 | Rohner et al. . | |
| 1,460,143 | 6/1923 | Ryzowicz et al. . | |
| 2,884,581 | 4/1959 | Schunemann et al. | 200/570 X |
| 3,049,599 | 8/1962 | Eck et al. | 200/51.17 |
| 3,363,070 | 1/1968 | Kussy | 200/51.17 |
| 4,071,720 | 1/1978 | Krajci et al. | 200/565 X |
| 4,246,453 | 1/1981 | Marchese et al. | 200/565 X |
| 5,595,290 | 1/1997 | Hseih | 200/565 X |

FOREIGN PATENT DOCUMENTS

| | | | |
|---|---|---|---|
| 48775 | 6/1911 | Austria | 200/51.17 |
| 1094846 | 4/1957 | Germany | 200/565 |

*Primary Examiner*—Renee S. Luebke

*Attorney, Agent, or Firm*—Merchant, Gould, Smith, Edell, Welter & Schmidt, P.A.

[57] ABSTRACT

A bi-directional or reversible multi-notch positioning device for use in an environment requiring clockwise and counter-clockwise rotation, including tactile and audible feedback to facilitate position changes in either clockwise or counter-clockwise directions. In one use of the present invention, the bi-directional multi-notch positioning device can be used as a three-way switch on a lamp socket for use with a three-way light bulb. The bi-directional three-way switch used in conjunction with a light socket allows either increasing or decreasing illumination by rotating a turnkey in either clockwise or counterclockwise directions.

7 Claims, 9 Drawing Sheets

5a

5b

5c

5d

9a

9b

9c

9d

BI-DIRECTIONAL MULTI-POSITION POSITIONING DEVICE

FIELD OF THE INVENTION

The present invention relates to multi-position positioning devices. In particular, the present invention relates to multi-position switches for use on three-way electric lamp fixtures to control the illumination of three-way light bulbs or for use in any other electrical or mechanical system utilizing rotating multi-position positioning devices.

BACKGROUND OF THE INVENTION

Three-way incandescent light bulbs having two filaments which can be separately or simultaneously energized can be used in conjunction with appropriate sockets and switches to form a three-way lighting system providing multiple illumination levels. Illumination of the light bulb is controlled by moving a turnkey or similar control of the three-way switch into different locations. Sockets and switches used with three-way light bulbs provide an electrical mechanical system for energizing one filament with a turn of the turnkey, then the other filament with a second turn of the turnkey, and then both filaments with a third turn of the turnkey.

A three-way light bulb is commonly employed in a three-way socket with the off, low, medium, and high illumination levels effectively controlled by a three-way switch. However, control of the illumination levels is unduly limited because the turnkey controlling filament energization may be turned in only one direction. The light bulb illumination controlled by such a switch can be changed only in a fixed sequence, commonly from off to low to medium to high and back to off again, by rotating the turnkey clockwise.

The restriction of rotation of the turnkey in only one direction creates inconvenience in operation of the switch and excess wear of the switch internal parts. For example, a three-way lighting fixture that needs to be turned from off to its highest illumination level and then sometime later turned off must first have its turnkey turned clockwise three positions to the high illumination level and then later turned one more position to off. Turning the turnkey three positions from off to high requires greater dexterity and concentration and creates greater wear to the switch than if the switch had only to be moved one position from off to high. Similarly, a light that is used in an area only requiring low level illumination requires first turning the turnkey one position to the low illumination level and then sometime later turning three more positions to off. In this situation, turning the turnkey three position from low to off requires greater dexterity and concentration and creates greater wear to the switch than if the switch had only to be moved one position from low to off.

Leuiton® Manufacturing Company, Incorporated manufactures a turn knob, three-way electrolier for use with two filament light bulbs in a sequence of low-medium-high-off which may be used as the starting point for understanding the present invention.

One known improved method of operating existing three-way lighting fixtures is to add a two position on/off switch in series with the one-directional three-way light switch. This additional switch is typically wired into the lighting fixture's power cord between the wall plug and the three-way switch. This allows the three-way switch to be permanently left in either the low, medium, or high position and the lamp turned on and off by the two-position on/off switch. This solution is not advantageous because it adds the expense of an additional switch and may cause confusion due to the existence of two similarly arranged switches which can control the lamp.

SUMMARY OF THE INVENTION

The present invention generally provides a bi-directional positioning device that controls changes within a system by rotating a turnkey in either clockwise or counterclockwise directions.

The present invention provides a bi-directional positioning device that controls a plurality of conditions within a system when turned in one direction and a plurality of similar or different conditions within the system when turned in the opposite direction and simultaneously providing the operator with tactile and audible feedback to facilitate turning the turnkey between positions.

BRIEF DESCRIPTION OF THE DRAWINGS

The objects and features of the invention noted above are explained in more detail with reference to the figures in which like reference numerals denote the elements and in which.

DETAILED DESCRIPTION OF THE DRAWINGS

Figure 1:
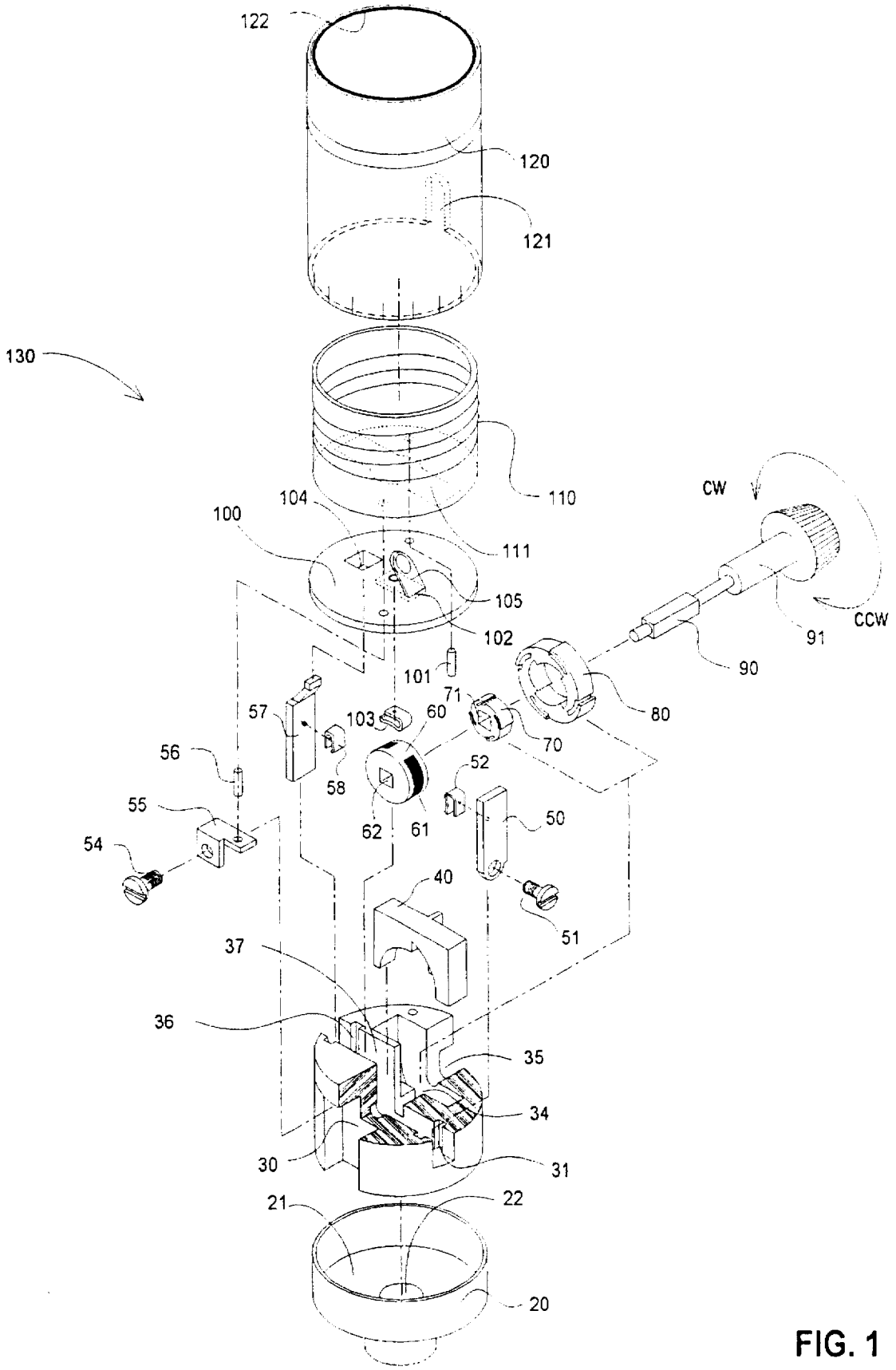
FIG. 1 is an exploded perspective view of an embodiment of the present invention utilizing ratcheting concentric-rings driven by a shaft that is engaged with the three-way switch knob.

Referring to the drawings, FIG. 1 depicts an embodiment of the present invention, a bi-directional multi-position positioning device, utilized in a lamp socket and switch 130. Although the embodiments of the present invention described herein are disclosed as used with a lamp socket, it is to be understood that a bi-directional multi-position positioning device may be embodied in a number of different mechanisms utilizing rotating components which may be rotated manually by hand or by motors or solenoids. Therefore, the specific structural and functional details disclosed herein are not to be interpreted as limiting but rather as a representative basis for teaching one skilled in the art to employ the present invention in virtually any appropriately detailed system.

FIG. 1 shows a lamp socket and switch 130 having an outer housing comprised of a socket shell 120, an insulator liner 122, a socket cap 20, and flat washer insulator 21. A turnkey 91 and turnkey shaft 90 extend through keyway 121 in the socket shell 120 and an aperture 35 in base 30 to the interior of the outer housing. As described in detail hereafter, manual rotation of the turnkey 91 provides four different operating conditions of the lamp socket and switch corresponding to off, low, medium, and high illumination levels of the socketed three-way light bulb. The operating conditions may be selected in various sequences depending on direction of rotation of the turnkey 91. The screw shell 110 is comprised of a conductive metal and includes appropriate threading to releasably retain the three-way light bulb (not shown) therein. Below the screw shell 110, housed by the socket cap 20, positioned inside and integrated with a base 30, is a concentric-ring bi-directional multi-position positioning device.

Figure 2:
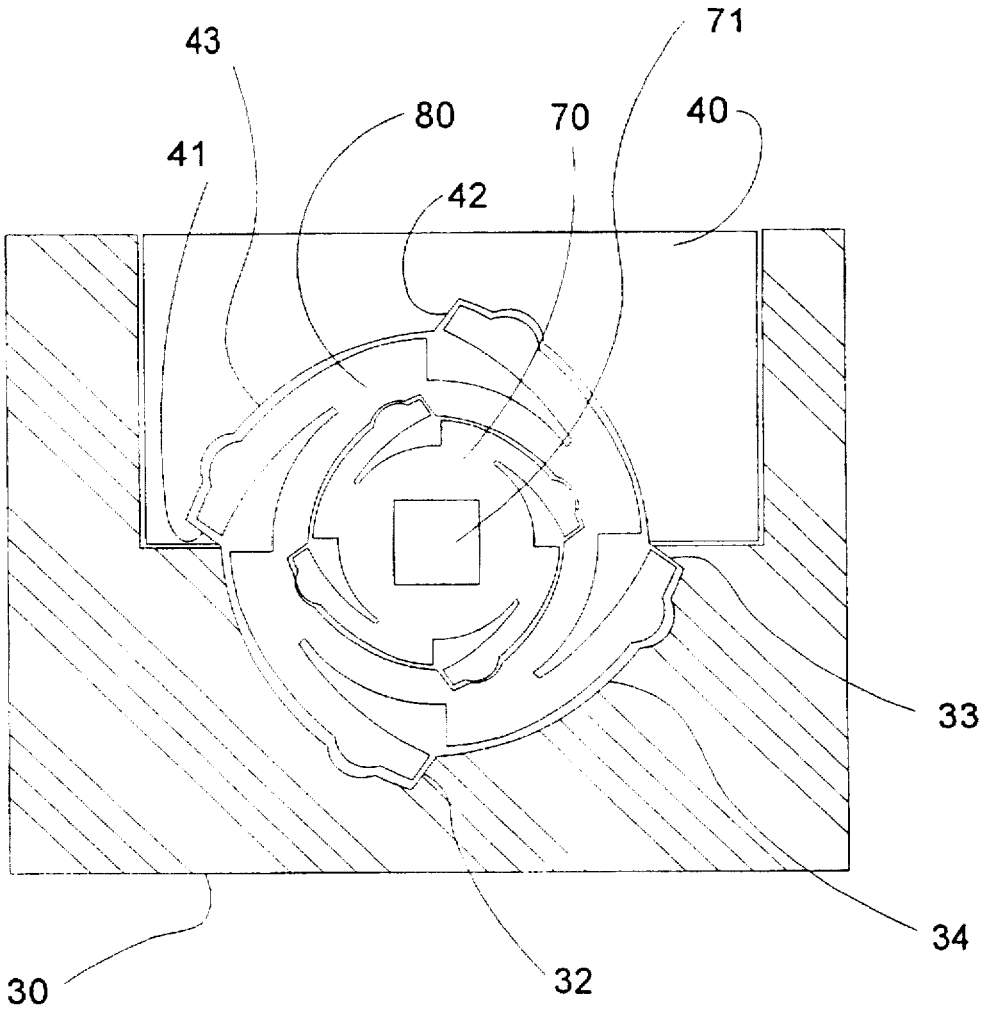
FIG. 2 is a view of the concentric-rings and their cavity within the cap and the base of the switch of FIG. 1.

As shown in FIG. 2, the concentric-ring bi-directional multi-position positioning device includes an inner positioning ring 70, outer positioning ring 80, base 30 and cap 40.

FIG. 2 also shows positioning of the outer positioning ring 80, the inner positioning ring 70, the ratchet stops 41 and 42 formed by the cap 40, and the ratchet stops 32 and 33 formed by the base 30. The concentric-ring bi-directional multi-position switch also includes a turnkey 91 and the turnkey shaft 90 (shown in FIG.1).

Figure 3:
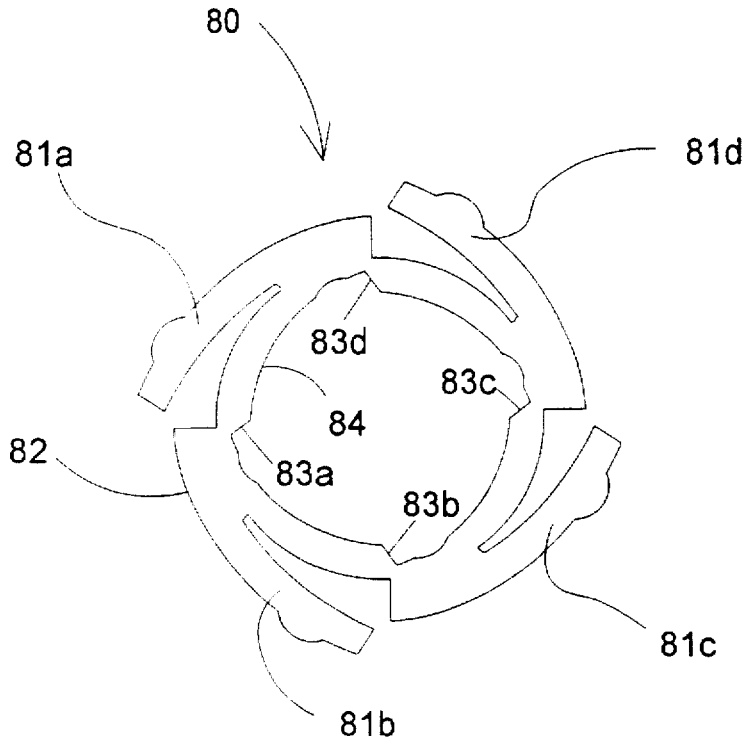
FIG. 3 is a view of the outer positioning ring of FIG. 1 showing a plurality of ratchet teeth, a plurality of ratchet stops, an inner peripheral surface, and an outer peripheral surface.

As shown in FIG. 3, the outer positioning ring 80 has a plurality of ratchet teeth 81*a*–81*d* extending radially outward from an outer peripheral surface 82 and a plurality of ratchet stops 83*a*–83*d* extending radially inward from an inner peripheral surface 84.

Figure 4:
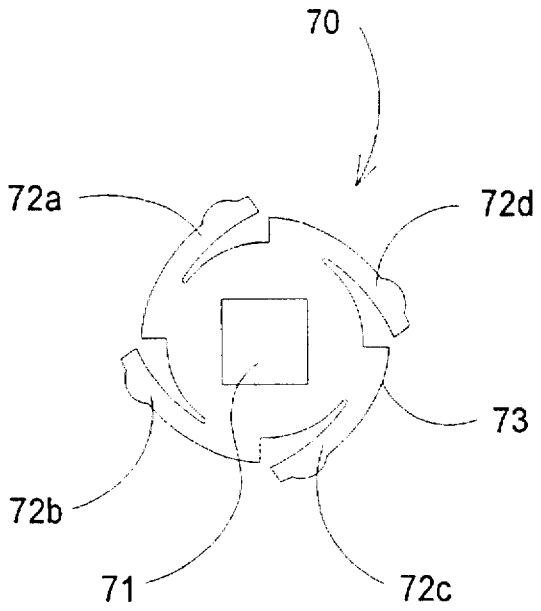
FIG. 4 is a view of the inner positioning ring of FIG. 1 showing a plurality of ratchet teeth, an orifice, and an outer peripheral surface.

As shown in FIG. 4, the inner positioning ring 70 which is supported within the outer positioning ring 80 has a plurality of ratchet teeth 72*a*–72*d* extending radially outward from its outer peripheral surface 73 and an orifice 71 extending therethrough. Orifice 71 provides for directional control of the rotational movement of the concentric-ring bi-directional multi-position positioning device through engagement of a turnkey shaft 90.

As shown in FIG. 1, the turnkey 91 is fixed to one end of turnkey shaft 90 such that rotation of turnkey 91 in either the clockwise or counterclockwise direction causes rotation of turnkey shaft 90 in the same direction as the turnkey 91. Turnkey shaft 90 also fittingly extends through an orifice 62 within a disk shaped slip ring insulator 60 with the orifice 62 being substantially the same size as that of orifice 71 extending through the inner positioning ring 70.

The slip ring insulator 60 is formed of a dielectric material and has a slip ring conductor 61 comprised of an electrically conductive material formed about the slip ring insulator 60 periphery. The slip ring conductor 61 covers and conforms to about three-fourths of the slip ring insulator 60 periphery. The slip ring insulator 60 is positioned in slip ring cavity 37 of base 30.

The main contact terminal 50 is retained by base 30 by means of recess 31 in base 30. The main contact terminal 50 has a main brush 52 for establishing contact between main contact terminal 50 and slip ring conductor 61 or the slip ring insulator 60 depending on the slip ring insulator 60 position. Main contact terminal 50 and main brush 52 are formed of an electrically conductive material. The main brush 52 remains flexibly engaged with the slip ring conductor 61 to maintain electrical contact between the main contact terminal 50 and the slip ring conductor 61 when the slip ring insulator 60 is positioned to place the slip ring conductor 61 in radial alignment with the main brush 52.

The central contact terminal 105 has a first and second portion with the first portion attached to a central brush 103. The central brush 103 is positioned and biased such that it is in contact with the slip ring conductor 61 or the slip ring insulator 60 depending on the slip ring insulator 60 position. The central brush 103 is ninety degrees away from the main brush 52 attached to main contact terminal 50, about the axis of rotation of the slip ring insulator 60. The central contact terminal 105 and central brush 103 are comprised of a conductive material and the central brush 103 remains flexibly engaged with the slip ring conductor 61 to maintain electrical contact between the central contact terminal 105 and the slip ring conductor 61 when the slip ring insulator 60 is positioned to place the slip ring conductor 61 in radial alignment with the central brush 103. The central contact terminal 105 has a second portion that extends through the first orifice 102 in insulator 100 and through the orifice 111 into the screw shell 110 to contact the center terminal of a standard three-way bulb (not shown).

An outer contact terminal 57 is retained by base 30 by means of recess 36 in base 30, and like the main contact terminal 50 and central contact terminal 105 is comprised of a conductive material. The outer contact terminal 57 is attached to an outer brush 58 that is biased into contact with the slip ring conductor 61 or slip ring insulator 60 depending on the slip ring insulator 60 position. The outer brush 58 remains flexibly engaged with the slip ring conductor 61 to maintain electrical contact between the outer contact terminal 57 and the slip ring conductor 61 when the slip ring insulator 60 is positioned to place the slip ring conductor 61 in radial alignment with the outer brush 58. The outer brush 58 of the outer contact terminal 57 is located ninety degrees away from the central brush 103 of the central contact terminal 105, about the axis of rotation of the slip ring insulator 60. In a manner similar to the central contact terminal 105, the outer contact terminal 57 extends upwardly and through a second orifice 104 of the insulator 100 and through the orifice 111 into the screw shell 110 to contact the annular ring terminal of a standard three-way bulb (not shown).

A neutral contact terminal 55 is fixed to base 30, insulator 100, and screw shell 110 by rivet 56. The screw shell 110 and insulator 100 is additionally fixed to base 30 by rivet 101. In operation, an appropriate set of electrical wires are introduced through orifice 22 of socket cap 20 and the hot wire (not shown) connected to the main contact terminal So secured by screw 51 and the neutral wire (not shown) connected to the neutral contact terminal 55 secured by screw 54. The base 30 and cap 40 are comprised of an insulating phenolic or other suitable material.

The operation of the concentric-ring bi-directional multi-position positioning device may be readily envisioned from consideration of its operation in this embodiment where the positioning device is engaged by the turning of turnkey 91 to each of four positions as shown in FIGS. 5*a*, 5*b*, 5*c*, and 5*d*.

Figure 5:
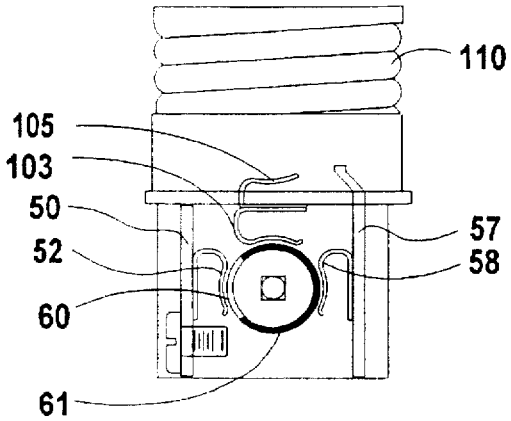
FIG. 5*a* is a view of a portion of the concentric-ring positioning device of FIG. 1 showing a slip ring insulator and a slip ring conductor in position with respect to a plurality of brushes and contacts in the off position.
FIG. 5*b* is a view of a portion of the concentric-ring positioning device of FIG. 1 showing the slip ring insulator and a slip ring conductor in position with respect to a plurality of brushes and contacts in the low illumination position.
FIG. 5*c* is a view of a portion of the concentric-ring positioning device of FIG. 1 showing the slip ring insulator and a slip ring conductor in position with respect to a plurality of brushes and contacts in the medium illumination position.
FIG. 5*d* is a view of a portion of the concentric-ring positioning device of FIG. 1 showing the slip ring insulator and a slip ring conductor its position with respect to a plurality of brushes and contacts in the high illumination position.
Figure 5:
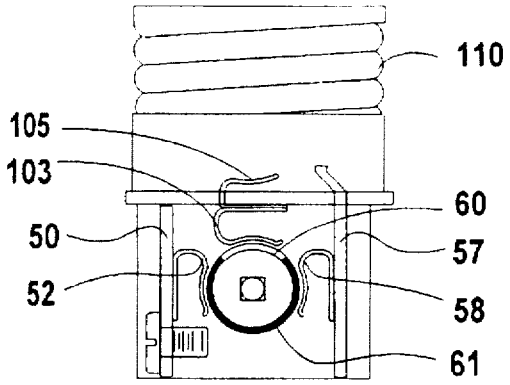
Figure 5:
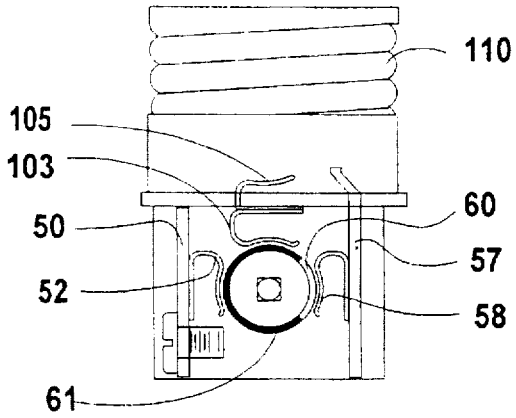
Figure 5:
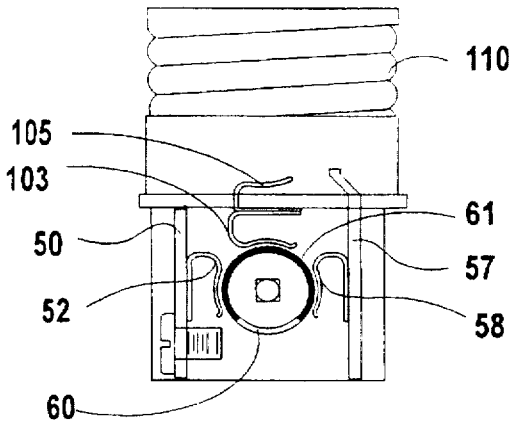

FIG. 5*a* shows the position of the slip ring insulator 60 and slip ring conductor 61 operated by turnkey 91 in the off position since the slip ring conductor 61 is not in contact with the main brush 52 and no circuit is formed and the bulb screwed into the screw shell 110 will not be illuminated. This is defined as the first position or "off" operating condition.

Rotation of the turnkey 91 clockwise one position as evidenced by audible and tactile feedback causes a ninety degree rotation as shown in FIG. 5*b*, bringing the slip ring insulator 60 and slip ring conductor 61 to the position shown. In this position the slip ring conductor 61 extends between the main brush 52 and the outer brush 58. The central brush 103 is in contact with the slip ring insulator 60. In this second position, main contact terminal 50, main brush 52, slip ring conductor 61, outer brush 58, and outer contact terminal 57 form a circuit through the low intensity filament of a three-way light bulb, placing such light bulb in the "low" operating condition.

Rotation of the turnkey 91 clockwise an additional position as evidenced by audible and tactile feedback causes another ninety degree rotation, as shown in FIG. 5*c*, bringing the slip ring insulator 60 and slip ring conductor 61 to a third position. In this position the slip ring conductor 61 extends between the main brush 52 and the central brush 103. The outer brush 58 is in contact with the slip ring insulator 60. In this third position, main contact terminal 50, main brush 52, slip ring conductor 61, central brush 103, and central contact terminal 105 will form a circuit through the high intensity filament of the three-way light bulb, placing the light bulb in the "medium" operating condition.

A final rotation of turnkey 91 in a clockwise direction as evidenced by audible and tactile feedback brings the slip ring insulator 60 to a fourth position shown in FIG. 5*d*. In this position the slip ring conductor 61 extends between the main brush 52, central brush 103, and outer brush 58. In this fourth position, main contact terminal 50, main brush 52, slip ring conductor 61, outer brush 58, and outer contact terminal 57 form a circuit through the low intensity filament and main contact terminal 50, main brush 52, slip ring conductor 61, central brush 103, and central contact terminal 105 form a circuit through the high intensity filament of the three-way light bulb, placing such light bulb in the "high" operating condition.

The rotation of turnkey 91 can occur in either clockwise or counterclockwise direction and can be reversed at will as a result of the concentric-ring bi-directional multi-position positioning device being used in the light socket and switch. A standard prior art three-way lamp switch which does not include the bi-directional multi-position positioning device can only operate in one direction and one sequence. Operation of these existing three-way lamp switches are limited because their turnkey may be turned in only one direction to change illumination levels of the lamp. Therefore, a lamp's operating condition may be changed in one sequence only, typically from off to low to medium to high and back again to off. Existing three-way lamp switches do not allow rotation of the turnkey in the opposite direction to provide illumination changes in an alternate sequence.

FIG. 2 illustrates that the concentric-ring bi-directional multi-position positioning device utilized contains two concentric-rings, the outer positioning ring 80 and the inner positioning ring 70, ratchet stops 41 and 42 formed by cap 40, and ratchet stops 32 and 33 formed by base 30. The outer positioning ring 80 is positioned and supported inside a cavity formed by cap 40 and the positioning ring cavity 34 (shown in FIG. 1) of base 30. The inner positioning ring 70 is positioned and supported inside an opening within the outer positioning ring 80.

The outer positioning ring 80 is comprised of a flexible material that is biased to engage the inner peripheral surface 43 of cap 40 and the positioning ring cavity 34 of base 30 upon changing positions. Turning turnkey shaft 90 (not shown), which extends through orifice 71 of inner positioning ring 70, in a counterclockwise direction causes inner positioning ring 70 to rotate in a counterclockwise direction while outer positioning ring 80 remains stationary. Outer positioning ring 80 cannot rotate in a counterclockwise direction because its ratchet teeth 81*a*–81*d* are lockably engaged with the ratchet stops 41 and 42 of cap 40 and the ratchet stops 32 and 33 of base 30. Inner positioning ring 70 rotates counterclockwise while its ratchet teeth 72*a*–72*d* slidably engage the inner peripheral surface 84 (shown in FIG. 3) of outer positioning ring 80. With each ninety degree rotation of turnkey shaft 90 in the counterclockwise direction, ratchet teeth 72*a*–72*d* of inner positioning ring 70 snap into alignment with the ratchet stops 83*a*–83*d* (shown in FIG. 3) of outer positioning ring 80, aligning the bi-directional multi-position positioning device in one of its four operating positions providing audible and tactile feedback to the operator turning turnkey 91.

As shown in FIG. 2 the inner positioning ring 70 is comprised of a flexible material that is biased to engage the inner peripheral surface 84 of outer positioning ring 80 upon changing positions. Turning turnkey shaft 90 (not shown), which extends through orifice 71 of inner positioning ring 70, in a clockwise direction causes both the inner positioning ring 70 and the outer positioning ring 80 to rotate in a clockwise direction. Outer positioning ring 80 rotates with inner positioning ring 70 because the ratchet teeth 72*a*–72*d* (shown in FIG. 4) of the inner positioning ring 70 are lockably engaged with the ratchet stops 83*a*–83*d* (shown in FIG. 3) of the outer positioning ring 80. With each 90 degree rotation of turnkey shaft 90 in the clockwise direction, ratchet teeth 81*a*–81*d* (shown in FIG. 3) of outer positioning ring 80 snap into alignment with the ratchet stops 41 and 42 of the cap 40 and the ratchet stops 32 and 33 of the base 30 aligning the concentric-ring bi-directional multi-position positioning device in one of its four operating positions and providing audible and tactile feedback to the operator turning turnkey 91.

Figure 6:
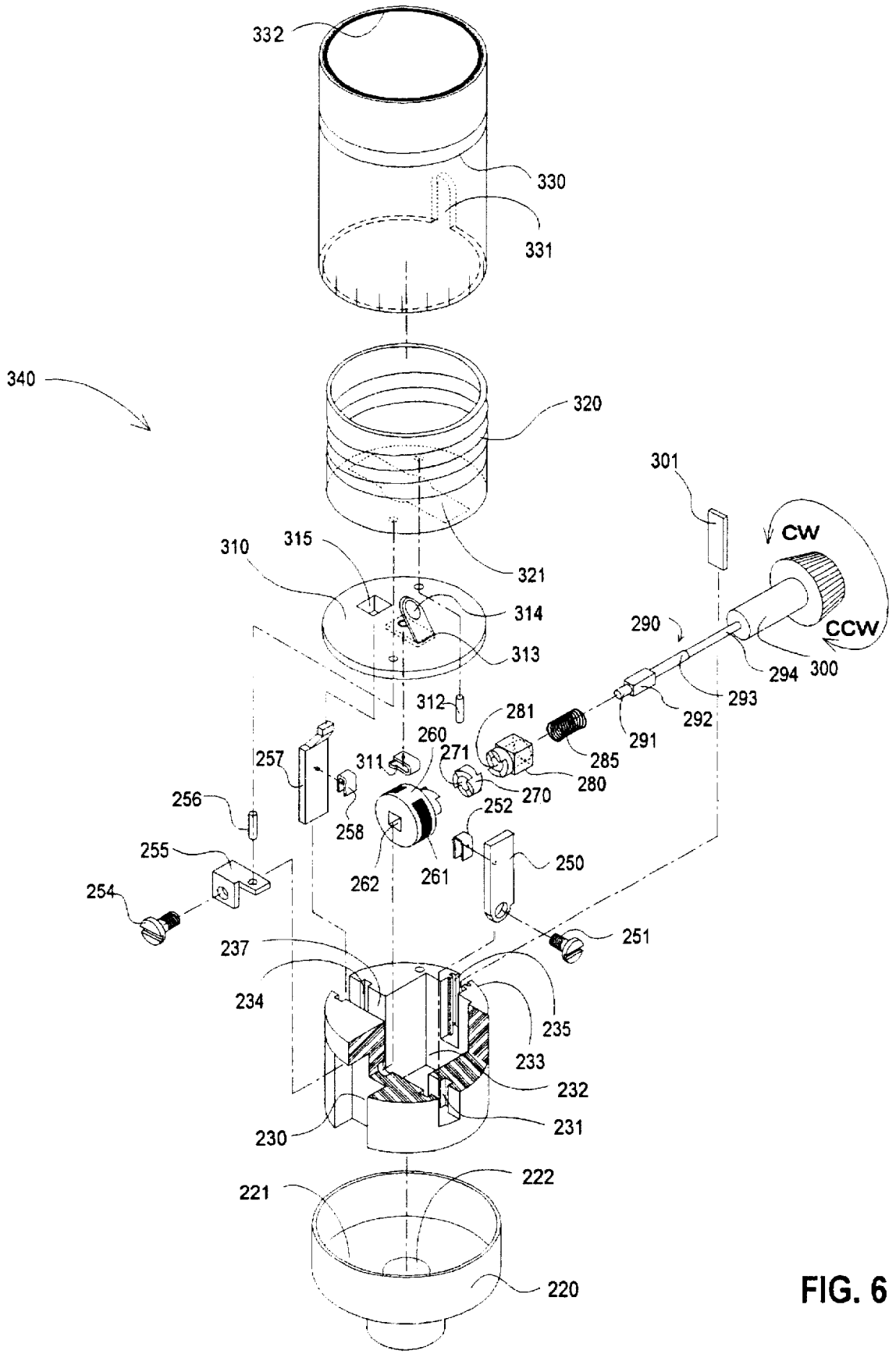
FIG. 6 is an exploded perspective view of an alternative embodiment of the socket and switch utilizing axial cylinders.

In another embodiment of the present invention shown in FIG. 6, a bi-directional multi-positioning device is utilized in the lamp socket and switch 340. Lamp socket and switch 340 has an outer housing comprised of a socket shell 330, an insulator liner 332, a socket cap 220, and flat washer insulator 221. A turnkey 300 and turnkey shaft 290 extend through keyway 331 in the socket shell 330 and an aperture 233 in base 230 to the interior of the outer housing. As described in detail hereafter, manual rotation of the turnkey 300 provides four different positions of the lamp socket and switch corresponding to off, low, medium, and high illumination levels of the socketed three-way light bulb and said operating conditions may be selected in various sequences depending on direction of rotation of the turnkey 300. The screw shell 320 is comprised of a conductive metal and includes appropriate threading to releasably retain the light bulb (not shown) therein. Below the screw shell 320, housed by the socket cap 220, positioned inside and integrated with a base 230, is a axial bi-directional multi-position positioning device.

FIG. 6 also illustrates the parts making up the bi-directional multi-positioning device, including a slip ring insulator 260, a slip ring conductor 261, an idler 270, a slider 280 with orifice 281 and ratchet teeth, a spring 285, a turnkey 300, and a turnkey shaft 290.

Figure 7:
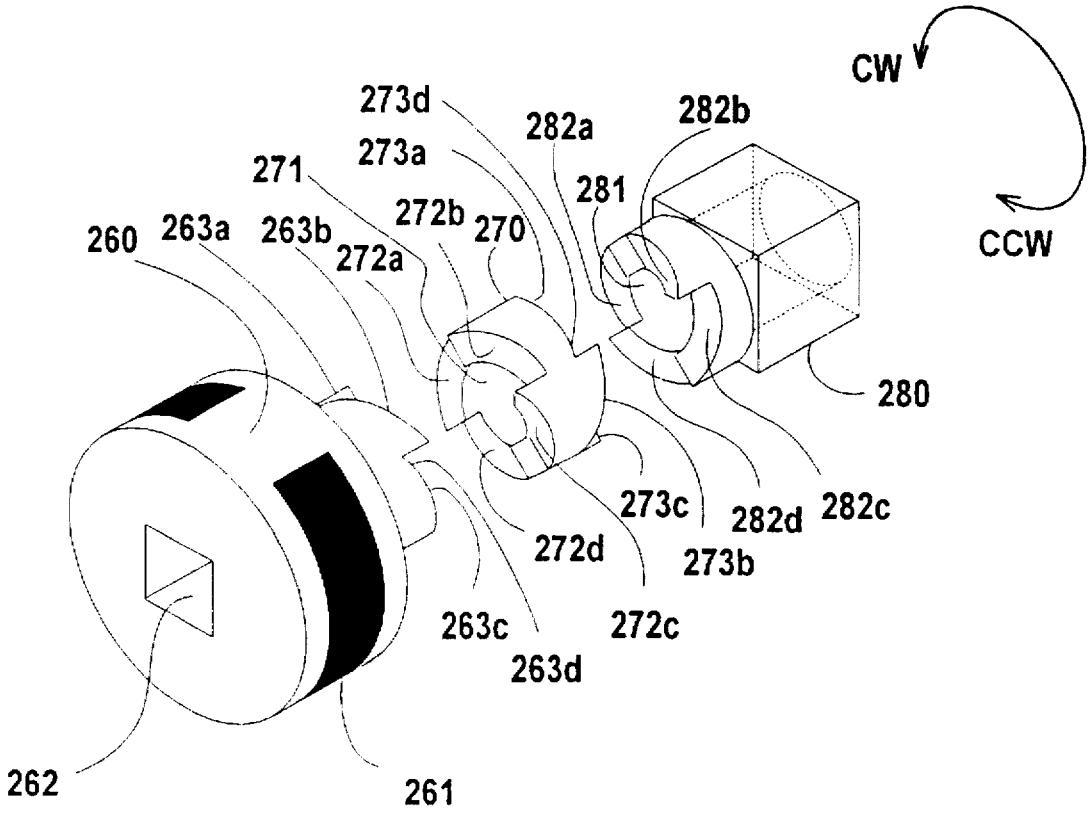
FIG. 7 is an exploded perspective view of a slip ring insulator, a slip ring conductor, an idler, and a slider within a base of the positioning device of FIG. 6.

As shown in FIG. 7, the slip ring insulator 260 has a plurality of ratchet teeth 263*a*–263*d* extending axially outward and an orifice 262 extending therethrough. The idler 270 has a first set of clockwise ratchet stops 272*a*–272*d* extending axially toward the slip ring insulator 260, a second set of counterclockwise ratchet stops 273*a*–273*d* extending axially toward slider 280, and a round orifice 271 passing therethrough. The slider 280 has a round disk with a plurality of ratchet teeth 282*a*–282*d* extending axially toward idler 270, a square cross-section outer surface portion extending axially away from idler 270, and an orifice 281 extending therethrough with a smaller diameter round first part and a larger diameter round second part.

Figure 8:
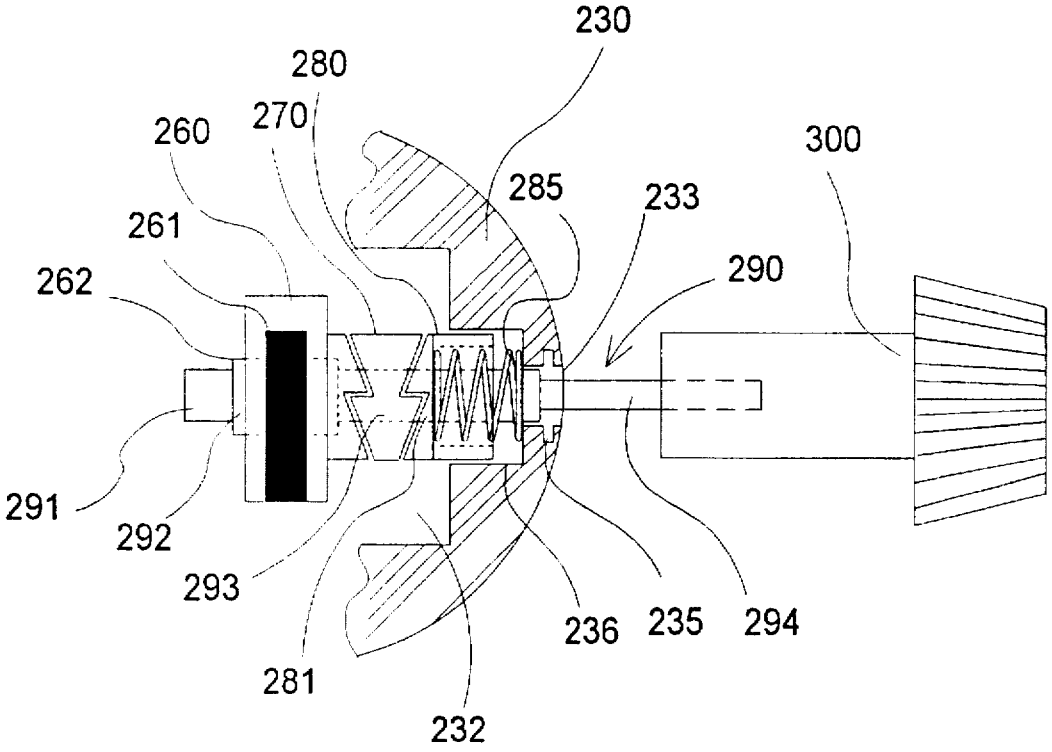
FIG. 8 is a top view of the axial-cylindrical positioning device showing a slip ring insulator, an idler, a slider, and a spring and their locations within a base with respect to a turnkey and a turnkey shaft.

As shown in FIG. 8, turnkey shaft 290 is positioned in cavity 232 of base 230 with a round cross-section first part 291, a square cross-section second part 292 positioned in orifice 262 in slip ring insulator 260, a round cross-section third part 293 aligned with idler 270 and slider 280, and a round cross-section fourth part 294 aligned with aperture 233 of base 230. Turnkey 300 is fixed to one end of turnkey shaft 290 such that rotation of turnkey 300 in either clockwise or counterclockwise direction causes rotation of turnkey shaft 290 in the same direction as the turnkey 300. The square cross-section second part 292 of turnkey shaft 290 fittingly extends through the orifice 262 of the slip ring insulator 260. Turnkey shaft 290 also extends through a spring 285. A retainer 301 (shown in FIG. 6) within recess 235 in base 230 secures the turnkey shaft 290 to the base 230 while allowing rotation of the turnkey shaft 290.

As shown in FIG. 6, the slip ring insulator 260 is formed of a dielectric material and has a slip ring conductor 261, comprised of an electrically conductive material formed about the slip ring insulator 260 periphery. The slip ring conductor 261 covers and conforms to about three-fourths of the slip ring insulator 260 periphery. The slip ring insulator 260 is positioned in slip ring cavity 237 of base 230.

The main contact terminal 250 is retained by base 230 by means of recess 231 in base 230. The main contact terminal 250 has a main brush 252 for establishing contact between main contact terminal 250 and slip ring conductor 261 or the slip ring insulator 260 depending on the slip ring insulator 260 position. Main contact terminal 250 and main brush 252 are formed of an electrically conductive material. The main brush 252 remains flexibly engaged with the slip ring conductor 261 to maintain electrical contact between the main contact terminal 250 and the slip ring conductor 261 when the slip ring insulator 260 is positioned to place the slip ring conductor 261 in radial alignment with the main brush 252.

The central contact terminal 314 has a first and second portion with the first portion attached to a central brush 311. The central brush 311 is positioned and biased such that it is in contact with the slip ring conductor 261 or the slip ring insulator 260 depending on the slip ring insulator 260 position. The central brush 311 is ninety degrees away from the main brush 252 attached to main contact terminal 250, about the axis of rotation of the slip ring insulator 260. The central contact terminal 314 and central brush 311 are comprised of a conductive material and the central brush 311 remains flexibly engaged with the slip ring conductor 261 to maintain electrical contact between the central contact terminal 314 and the slip ring conductor 261 when the slip ring insulator 260 is positioned to place the slip ring conductor 261 in radial alignment with the central brush 311. The central contact terminal 314 has a second portion that extends through the first orifice 313 in insulator 310 and through the orifice 321 into the screw shell 320 to contact the center terminal of a standard three way-bulb (not shown).

An outer contact terminal 257 is also located in recess 234 within the base 230 and like the main contact terminal 250 and central contact terminal 314 is comprised of a conductive material. The outer contact terminal 257 is attached to an outer brush 258 that is biased into contact with the slip ring conductor 261 or slip ring insulator 260 depending on the slip ring insulator 260 position. The outer brush 258 remains flexibly engaged with the slip ring conductor 261 to maintain electrical contact between the outer contact terminal 257 and the slip ring conductor 261 when the slip ring insulator 260 is positioned to place the slip ring conductor 261 in radial alignment with the outer brush 258. The outer brush 258 of the outer contact terminal 257 is located ninety degrees away from the central brush 311 of the central contact terminal 314, about the axis of rotation of the slip ring insulator 260. In a manner similar to the central contact terminal 314, the outer contact terminal 257 extends upwardly and through a second orifice 315 of the insulator 310 into the screw shell 320 for contact with the annular ring terminal of a standard three-way bulb (not shown).

A neutral contact terminal 255 is fixed to the base 230, insulator 310, and screw shell 320 by rivet 256. The screw shell 320 and insulator 310 is additionally fixed to base 230 by rivet 312. In operation, an appropriate set of electrical wires are introduced through orifice 222 of socket cap 220 and the hot wire (not shown) connected to the main contact terminal 250 secured by screw 251 and the neutral wire (not shown) connected to the neutral contact terminal 255 secured by screw 254. The base 230 is comprised of an insulating phenolic or other suitable material.

The operation of the axial bi-directional multi-position positioning device shown in FIGS. 6 and 8 may be readily envisioned from consideration of its operation in this embodiment where said positioning device is engaged by the turning of turnkey 300 to each of four positions as shown in FIGS. 9*a*, 9*b*, 9*c*, and 9*d*.

Figure 9:
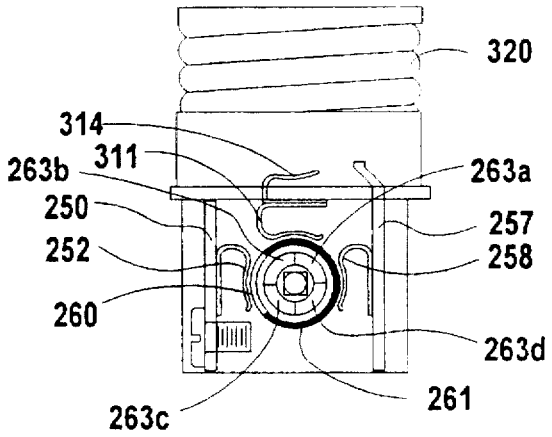
FIG. 9*a* is a view of a portion of the axial-cylindrical positioning device of FIG. 6 showing a slip ring insulator and a slip ring conductor in position with respect to a plurality of brushes and contacts in the off position.
FIG. 9*b* is a view of a portion of the axial-cylindrical positioning device of FIG. 6 showing the slip ring insulator and a slip ring conductor in position with respect to a plurality of brushes and contacts in the low illumination position.
FIG. 9*c* is a view of a portion of the axial-cylindrical positioning device of FIG. 6 showing the slip ring insulator and a slip ring conductor in position with respect to a plurality of brushes and contacts in the medium illumination position.
FIG. 9*d* is a view of a portion of the axial-cylindrical positioning device of FIG. 6 showing the slip ring insulator.and a slip ring conductor its position with respect to a plurality of brushes and contacts in the high illumination position.
Figure 9:
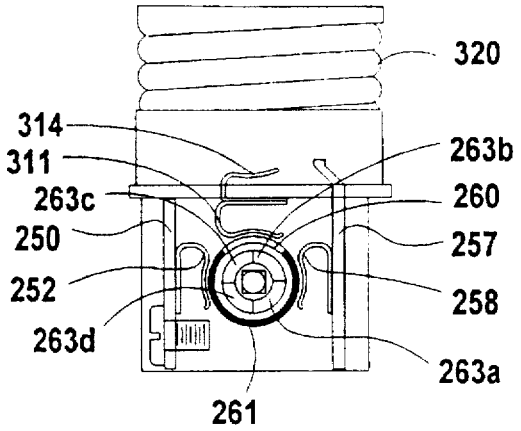
Figure 9:
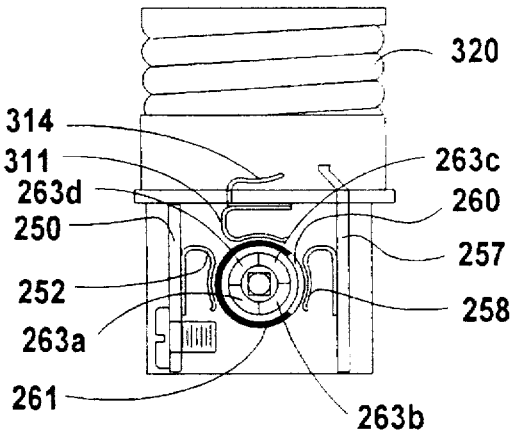
Figure 9:
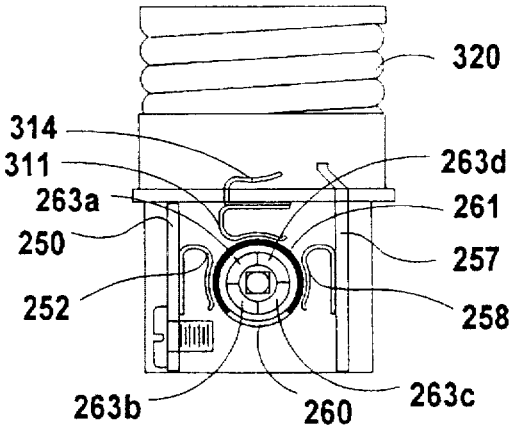

FIG. 9*a* shows the position of the slip ring insulator 260 and slip ring conductor 261 operated by turnkey 300 in the off position since the slip ring conductor 261 is not in contact with the main brush 252 and no circuit is formed and the bulb screwed into the screw shell 320 will not be illuminated. This is defined as the first position or "off" operating condition.

Rotation of the turnkey 300 clockwise one position as evidenced by audible and tactile feedback causes a ninety degree rotation as shown in FIG. 9*b*, bringing the slip ring insulator 260 and slip ring conductor 261 to the position shown. In this position the slip ring conductor 261 extends between the main brush 252 and the outer brush 258. The central brush 311 is in contact with the slip ring insulator 260. In this second position, main contact terminal 250, main brush 252, slip ring conductor 261, outer brush 258, and outer contact terminal 257 forms a circuit through the low intensity filament of a three-way light bulb, placing such light bulb in the "low" operating condition.

Rotation of the turnkey 300 clockwise an additional position as evidenced by audible and tactile feedback causes another ninety degree rotation, as shown in FIG. 9*c*, bringing the slip ring insulator 260 and slip ring conductor 261 to a third position. In this position the slip ring conductor 261 extends between the main brush 252 and the central brush 311. The outer brush 258 is in contact with the slip ring insulator 260. In this third position, main contact terminal 250, main brush 252, slip ring conductor 261, central brush 311, and central contact terminal 314 will form a circuit through the high intensity filament of the three-way light bulb, placing the light bulb in the "medium" operating condition.

A final rotation of turnkey 300 in a clockwise direction as evidenced by audible and tactile feedback brings the slip ring insulator 260 to a fourth position shown in FIG. 9*d*. In this position the slip ring conductor 261 extends between the main brush 252, central brush 311, and outer brush 258. In this fourth position, main contact terminal 250, main brush 252, slip ring conductor 261, outer brush 258, and outer contact terminal 257 will form a circuit through the low intensity filament and main contact terminal 250, main brush 252, slip ring conductor 261, central brush 311, and central contact terminal 314 will form a circuit through the high intensity filament of the three-way light bulb, placing such light bulb in the "high" operating condition.

In this embodiment as shown in FIG. 8 the axial bi-directional multi-position positioning device is comprised of three cylindrical elements, slip ring insulator 260, idler 270, and the slider 280, all having orifices therein, the spring 285, the turnkey shaft 290, and the turnkey 300. The slider 280 is positioned and supported by an inner peripheral surface 236 in base 230 which allows the slider to move axially along turnkey shaft 290 but not rotate about the axis of turnkey shaft 290. The idler 270 is positioned on turnkey shaft 290 and is free to rotate about the axis of turnkey shaft 290. Slip ring insulator 260 is positioned within base 230 on turnkey shaft 290.

In FIG. 7 the slip ring insulator 260 has a set of four equally spaced ratchet teeth 263*a*–263*d* formed on one of its axial surfaces. The idler 270 has a set of four equally spaced clockwise ratchet stops 272*a*–272*d* formed on one of its axial surfaces and a set of four equally spaced counterclockwise ratchet stops 273*a*–273*d* formed on its other axial surface. The slider 280 has a set of four equally spaced ratchet teeth 282*a*–282*d* on one of its axial surfaces The engagement of idler 270 with slip ring insulator 260 and slider 280 is caused by turnkey shaft 290, as shown in FIG. 8.

In FIG. 8 the spring 285 applies an axial force to slider 280 which compresses the slip ring insulator 260, idler 270, and slider 280 together along the axis of turnkey shaft 290. Slip ring insulator 260, idler 270, and slider 280 slidably and lockably engage each other as turnkey shaft 290 is rotated in either direction with spring 285 providing the flexibility required for slidability along the axis of the turnkey shaft 290.

In FIG. 8 turning turnkey shaft 290 in a counterclockwise direction causes slip ring insulator 260 to rotate in a counterclockwise direction while slider 280 is constrained from rotating. Idler 270 rotates counterclockwise with slip ring insulator 260 because the clockwise ratchet stops 272*a*–272*d* (shown in FIG. 7) of idler 270 are lockably engaged with the ratchet teeth 263*a*–263*d* (shown in FIG. 7) of slip ring insulator 260. The counterclockwise ratchet stops 273*a*–273*d* (shown in FIG. 7) of idler 270 slidably engage the ratchet teeth 282*a*–282*d* (shown in FIG. 7) of slider 280. With each rotation of turnkey shaft 290 in the counterclockwise direction, ratchet teeth 282*a*–282*d* (shown in FIG. 7) of slider 280 snap into alignment with the counterclockwise ratchet stops 273*a*–273*d* (shown in FIG. 7) of idler 270, aligning the axial bi-directional multi-position positioning device in one of its four operating positions providing audible and tactile feedback to the operator turning turnkey 300.

In FIG. 8 turning turnkey shaft 290 in a clockwise direction causes slip ring insulator 260 to rotate in a clockwise direction while slider 280 is constrained from rotating. Idler 270 remains fixed with slider 280 because its counterclockwise ratchet stops 273*a*–273*d* (shown in FIG. 7) are lockably engaged with the ratchet teeth 282*a*–282*d* (shown in FIG. 7) of slider 280. The clockwise ratchet stops 272*a*–272*d* (shown in FIG. 7) of idler 270 slidably engage the ratchet teeth 263*a*–263*d* (shown in FIG. 7) of slip ring insulator 260. With each rotation of turnkey shaft 290 in the clockwise direction, clockwise ratchet stops 272*a*–272*d* (shown in FIG. 7) of idler 270 snap into alignment with the ratchet teeth 263*a*–263*d* (shown in FIG. 7) of slip ring insulator 260, aligning the axial bi-directional multi-position positioning device in one of its four operating positions providing audible and tactile feedback to the operator turning turnkey 300.

What is claimed is:

1. A bi-directional multi-positioning device for use in a multi-illumination-level light socket comprising:

a disk-shaped surface having a plurality of ratchet teeth extending axially therefrom;

a disk-shaped idler having a plurality of ratchet stops extending axially out from a first side and a second set of ratchet stops extending axially out from a second side;

a slider having a disk-shaped first end having a plurality of ratchet teeth extending axially out therefrom and a second end having a square cross-section; and a spring positioned within said second end of said slider.

2. The bi-directional multi-position positioning device of claim 1 wherein said disk-shaped surface has a central orifice extending therethrough for engagement of a turnkey shaft.

3. The bi-directional multi-position positioning device of claim 1 wherein said disk-shaped idler has a central orifice extending therethrough for positioning on a turnkey shaft.

4. The bi-directional multi-position positioning device of claim 1 wherein said slider has a central orifice with a smaller radius in said first end of said slider and a larger radius in said second end of said slider extending therethrough for retaining said spring and positioning on a turnkey shaft.

5. The bi-directional multi-position positioning device of claim 1 including a turnkey shaft with a first end attached to a turnkey and a second end extending through said spring, through a central orifice of said slider, through a central orifice of said disk-shaped idler, and fittingly positioned within a central orifice of said disk-shaped surface.

6. A bi-directional multi-position positioning device used to control a plurality of conditions within a system when rotated, comprising:

a disk-shaped idler; and a disk-shaped surface fittingly positioned against a first side of said disk-shaped idler;

said disk-shaped surface and said disk-shaped idler configured such that rotation of said disk-shaped surface in a first direction causes said disk-shaped idler to rotate in said first direction; said disk-shaped idler not rotating when said disk-shaped surface is rotated in a second direction.

7. The bi-directional multi-position switch of claim 6 wherein said first direction is counterclockwise and said second direction is clockwise.

* * * * *